US009131754B2

(12) United States Patent
Basham

(10) Patent No.: US 9,131,754 B2
(45) Date of Patent: Sep. 15, 2015

(54) FORCE ABSORBING DEVICE

(76) Inventor: Marshall Aaron Vaughn Basham, Auckland Central (NZ)

( * ) Notice: Subject to any disclaimer, the term of this patent is extended or adjusted under 35 U.S.C. 154(b) by 0 days.

(21) Appl. No.: 14/119,330

(22) PCT Filed: May 24, 2012

(86) PCT No.: PCT/US2012/039318

§ 371 (c)(1),
(2), (4) Date: Nov. 21, 2013

(87) PCT Pub. No.: WO2012/162484

PCT Pub. Date: Nov. 29, 2012

(65) Prior Publication Data

US 2014/0182642 A1 Jul. 3, 2014

(30) Foreign Application Priority Data

May 24, 2011 (NZ) ..... 593047

(51) Int. Cl.

| | |
|---|---|
| ***A45B 9/02*** | (2006.01) |
| ***A45B 9/00*** | (2006.01) |
| ***A61H 3/02*** | (2006.01) |

(52) U.S. Cl.

CPC ..... *A45B 9/00* (2013.01); *A61H 3/0277* (2013.01); *A61H 3/0288* (2013.01); *A45B 2009/007* (2013.01); *A61H 2201/0107* (2013.01); *A61H 2201/0192* (2013.01)

(58) Field of Classification Search

CPC ..... A61H 3/0277; A61H 2003/0283
USPC ..... 135/75, 82; 280/819, 821
See application file for complete search history.

(56) References Cited

U.S. PATENT DOCUMENTS

| | | | | | |
|---|---|---|---|---|---|
| 1,336,844 | A | * | 4/1920 | Klousnitzer | 135/82 |
| 1,817,829 | A | * | 8/1931 | Lanning | 135/82 |
| 1,909,337 | A | * | 5/1933 | Crosbie | 135/83 |
| 2,397,499 | A | * | 4/1946 | McGowan | 135/82 |
| 2,484,401 | A | * | 10/1949 | Coie | 135/86 |
| 2,888,022 | A | * | 5/1959 | Fanning | 135/82 |
| 5,088,513 | A | * | 2/1992 | Ostermeyer | 135/82 |
| 5,564,451 | A | | 10/1996 | Hagberg | |
| 5,720,474 | A | * | 2/1998 | Sugiyama | 267/249 |
| 6,055,998 | A | | 5/2000 | Bader | |
| 6,131,592 | A | * | 10/2000 | Panizza | 135/66 |

(Continued)

FOREIGN PATENT DOCUMENTS

| | | | | |
|---|---|---|---|---|
| DE | 4136210 C1 | * | 12/1992 | A61H 3/02 |
| WO | 9842292 | | 10/1998 | |

*Primary Examiner* — Noah Chandler Hawk
(74) *Attorney, Agent, or Firm* — Tarolli, Sundheim, Covell & Tummino LLP

(57) ABSTRACT

A force absorbing device is provided for use with a walking aid having proximal and distal tubes arranged in a telescoping configuration for relative movement therebetween along a longitudinal axis. A proximal end member is affixed within a hollow bore of the proximal tube with no relative movement between the proximal tube and the proximal end member. A distal end member is longitudinally spaced from the proximal end member and affixed to a proximal end of the distal tube with no relative movement between the distal tube and the distal end member. A resilient damper is located longitudinally between, and affixed to both of, the proximal and distal end members. The resilient damper compresses under a compressive force to absorb at least a portion of the compressive force while permitting relative longitudinal movement between the proximal and distal tubes.

17 Claims, 4 Drawing Sheets

(56) References Cited

U.S. PATENT DOCUMENTS

| | | | | |
|---|---|---|---|---|
| 6,254,134 | B1 * | 7/2001 | Panizza | 280/819 |
| 6,286,529 | B1 * | 9/2001 | Olivera | 135/82 |
| 7,229,101 | B2 * | 6/2007 | Lenhart | 280/819 |
| 8,479,755 | B2 * | 7/2013 | Hung | 135/75 |
| 2001/0027802 | A1 * | 10/2001 | McGrath | 135/65 |
| 2002/0063369 | A1 * | 5/2002 | Huang | 267/153 |
| 2004/0025926 | A1 * | 2/2004 | Gin et al. | 135/68 |
| 2005/0129456 | A1 * | 6/2005 | Van Der Sluis | 403/109.1 |
| 2007/0252375 | A1 * | 11/2007 | Roiser | 280/816 |
| 2008/0116682 | A1 * | 5/2008 | Best et al. | 280/819 |
| 2011/0209733 | A1 | 9/2011 | Basham | |

* cited by examiner

FORCE ABSORBING DEVICE

RELATED APPLICATION

This application claims priority from New Zealand Provisional Application No. 593047, filed 24 May 2011, the subject matter of which is incorporated herein by reference in its entirety.

TECHNICAL FIELD

The present invention relates to an apparatus and method for use of a force absorbing device and, more particularly, to a force absorbing device for use with a walking aid.

BACKGROUND OF THE INVENTION

The use of walking aids such as walking sticks, hiking sticks, elbow crutches, axilla (underarm) crutches, walkers (A.K.A. "Zimmer frames"), rollators, or canes by users with short- or long-term leg injuries or other mobility concerns (e.g., a desire for sure-footedness on uneven ground for a hiking stick) is commonplace. As the tip of the walking aid is placed on a ground surface during walking, large forces can be transmitted to the upper body (at the hands, wrists, arms, shoulder, back, neck, elbow joints, shoulder joints, or other body structures), which can result in upper body pain and/or fatigue which, in turn, may lead to crutch palsy, aneurysms, thrombosis, or other serious conditions.

In an effort to damp the impact force resulting from the load transmitted to the user during walking, walking aids incorporating force, or shock, absorbers have been developed. These known shock-absorbing crutches include dedicated spring-loaded crutches where the shock absorber is permanently integrated into the crutch body and which requires the user to purchase and use the spring-loaded crutch in preference to the traditional rigid crutch.

The disadvantages associated with the use of dedicated shock-absorbing crutches include the extra expense of purchasing the new crutch, the increased weight of the crutch (which can affect maneuverability), and the inconvenience of using a shock absorbing crutch on ground surfaces which do not require shock absorption and which therefore can lead to instability for the user. More recently, conversion kits have been developed to fit to existing crutches. However, known shock absorbers may suffer from one or more of the following disadvantages:

Attachment of the shock absorber to the body of the crutch can require the use of tools and therefore be inconvenient for the user to easily convert between a shock-absorbing crutch and a rigid crutch.

Multiple individual parts can make fitment of the crutch with the shock absorber inconvenient.

Attachment of the shock absorber to the body of the crutch can affect the integrity of the body of the crutch and therefore present a danger of failure of the crutch during use.

The lack of adjustability of the shock absorber can make use of the shock-absorbing crutch limited over different surfaces or with users of different weight.

SUMMARY OF THE INVENTION

In an embodiment of the present invention, a force absorbing device is described for use with a walking aid having proximal and distal tubes arranged in a telescoping configuration for relative movement therebetween along a longitudinal axis. A proximal end member is provided for affixation within a hollow bore of the proximal tube with no relative movement between the proximal tube and the proximal end member. A distal end member is longitudinally spaced from the proximal end member, for affixation to a proximal end of the distal tube with no relative movement between the distal tube and the distal end member. A resilient damper is located longitudinally between, and affixed to both of, the proximal and distal end members. The resilient damper is at least partially located within the hollow bore of the proximal tube. The resilient damper compresses under a longitudinally oriented compressive force to absorb at least a portion of the longitudinally oriented compressive force while permitting relative longitudinal movement between the proximal and distal tubes.

In an embodiment of the present invention, a walking aid including a force absorbing device is described. The walking aid comprises a proximal tube having longitudinally spaced proximal and distal ends and defining a longitudinal axis. At least the distal end of the proximal tube has a hollow bore. A distal tube has longitudinally spaced proximal and distal ends and extends collinearly with the longitudinal axis. The distal tube is arranged telescopically with the proximal tube such that the proximal end of the distal tube is at least partially located within the hollow bore of the proximal tube. The force absorbing device comprises a proximal device end member for affixation within the hollow bore of the proximal tube with no relative movement between the proximal tube and the proximal device end member. A distal device end member is longitudinally spaced from the proximal end member, for affixation to the proximal end of the distal tube with no relative movement between the distal tube and the distal device end member. A resilient device damper is located longitudinally between, and affixed to both of, the proximal and distal device end members. The resilient device damper is at least partially located within the hollow bore of the proximal tube. The resilient device damper compresses under a longitudinally oriented compressive force to absorb at least a portion of the longitudinally oriented compressive force while permitting relative longitudinal movement between the proximal and distal tubes.

In an embodiment of the present invention, a method of absorbing compressive force generated in a walking aid is described. A proximal tube having longitudinally spaced proximal and distal ends and defining a longitudinal axis is provided, at least the distal end of the proximal tube having a hollow bore. A distal tube having longitudinally spaced proximal and distal ends and extending collinearly with the longitudinal axis is provided. The distal tube is arranged telescopically with the proximal tube such that the proximal end of the distal tube is at least partially located within the hollow bore of the proximal tube. A force absorbing device is provided, comprising a proximal device end member, a distal device end member longitudinally spaced from the proximal end member, and a resilient device damper, located longitudinally between, and affixed to both of, the proximal and distal device end members. The proximal device end member is affixed within the hollow bore of the proximal tube with no relative movement between the proximal tube and the proximal device end member. The distal device end member is affixed to the proximal end of the distal tube with no relative movement between the distal tube and the distal device end member. The resilient device damper is at least partially located within the hollow bore of the proximal tube. A longitudinally oriented compressive force of a first force magnitude and oriented toward the proximal direction is exerted upon the distal tube. The resilient device is compressed under the longitudinally oriented compressive force to absorb at least a portion of the longitudinally oriented compressive force of the first force magnitude. A longitudinally oriented compressive force of a second force magnitude is transferred from the resilient device, through the proximal device end member, to the proximal tube. The second force magnitude is lower than the first force magnitude. Relative longitudinal movement between the proximal and distal tubes is permitted via compression of the resilient device damper.

BRIEF DESCRIPTION OF THE DRAWINGS

For a better understanding of the invention, reference may be made to the accompanying drawings, in which.

DESCRIPTION OF EMBODIMENTS

Figure 1:
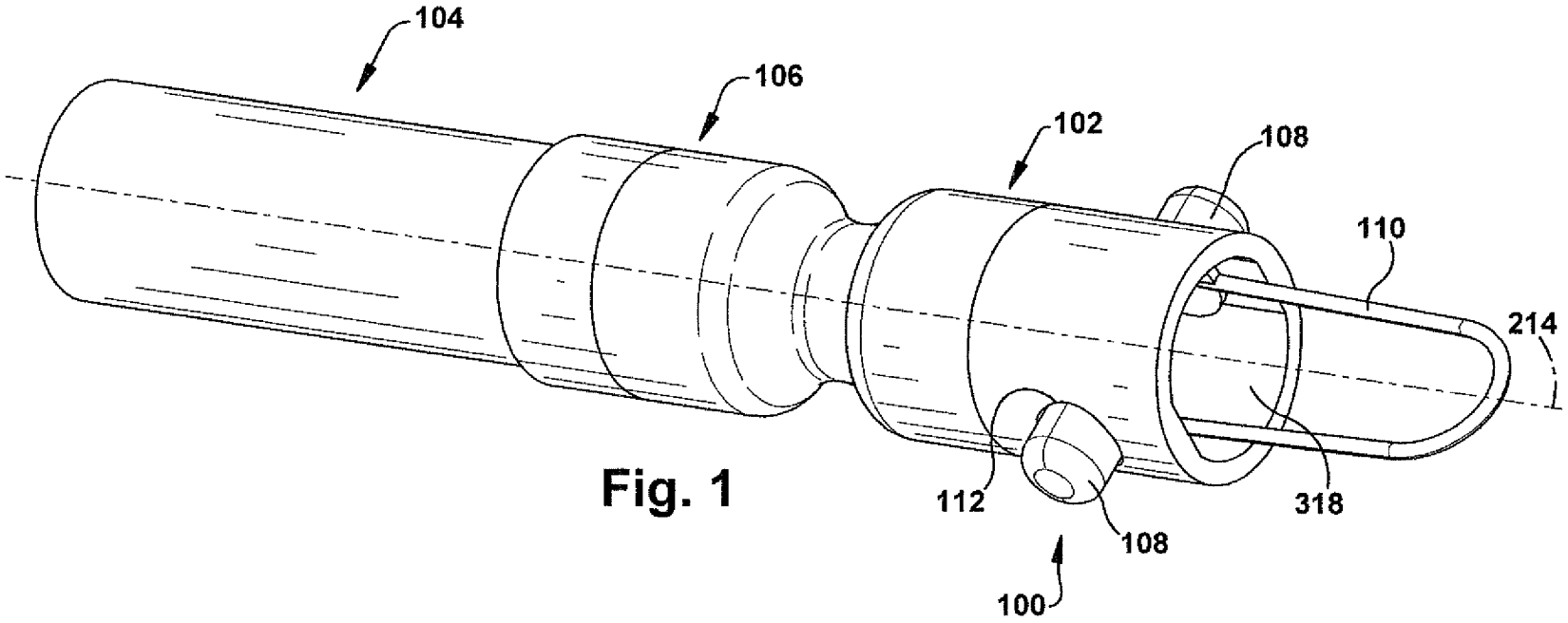
FIG. 1 is a side perspective view of an embodiment of the present invention.

In accordance with the present invention, FIG. 1 depicts a force absorbing device 100 for use with a walking aid. The device has proximal and distal end members 102 and 104, respectively, and a resilient damper 106.

As shown in the perspective view of FIG. 1, the proximal end member 102 may include means for operatively engaging a mechanical linkage device, such as the depicted snap buttons 108. Here, the snap buttons 108 are attached together by a biased arch 110 which pushes the snap buttons outward, through a pair of button apertures 112 in the proximal end member 102. Force can be exerted upon the snap buttons 108 to retract them into the proximal end member 102 for insertion of the proximal end member into another structure, and the snap buttons then "snap" outward when the force is released. In this manner, the snap buttons 108 can be used to mechanically link the proximal end member 102 with a surrounding apertured structure in a known manner. Other mechanical linkage devices include snap rings, spring buttons, nib springs, and the like. This linking property of the mechanical linkage device(s) will be useful to the device 100 as described below.

Figure 2:
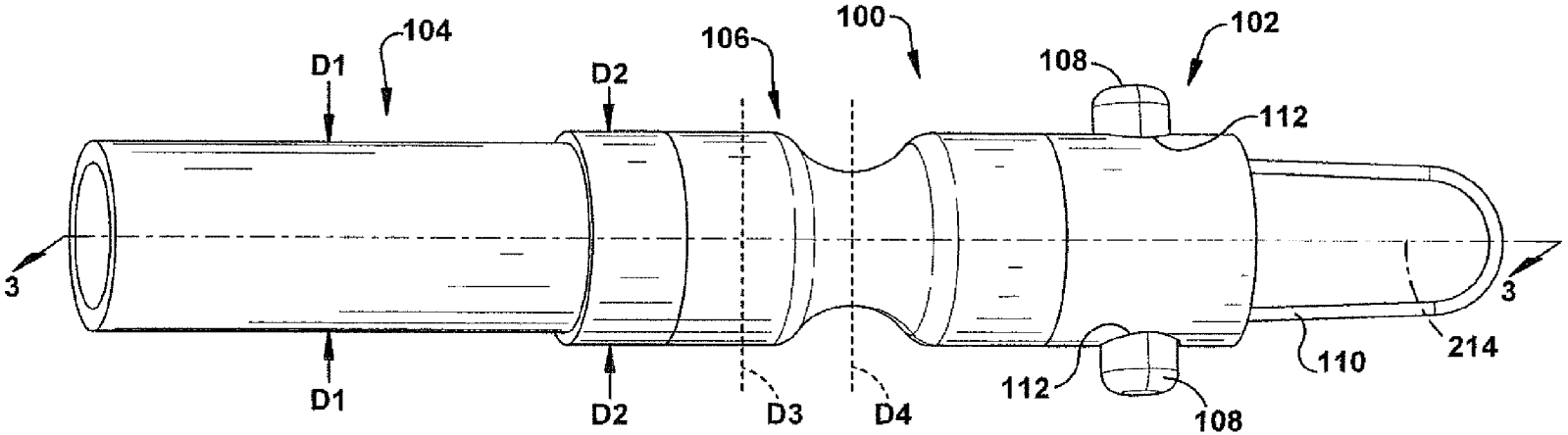
FIG. 2 is a side view of the embodiment of FIG. 1.

FIG. 2 depicts a side view of the device 100. As can be seen in this Figure, the distal end member 104 can include a plurality of diameters (D1 and D2, here) which are substantially perpendicular to a longitudinal axis 214 of the device 100. Optionally, D1 may be chosen to fit the distal end member 104 partially inside another structure, with the "shoulder" separating the D1 and D2 portions of the distal end member serving to prevent the entirety of the distal end member from entering the structure, as will be described below.

FIG. 2 also shows an optional variable profile shape of the resilient damper 106. In other words, the resilient damper 106 may be configured such that a cross-section (D3 in FIG. 2) of the resilient damper taken across a chosen location along the longitudinal axis 214 has a different cross-section footprint than a cross-section (D4 in FIG. 2) taken across at least one different location along the longitudinal axis. Here, the cross-section at D4 will be smaller than, but a similar shape to, the cross-section at D3. It is contemplated, though, that the shape and/or size of the footprint at each cross-section may differ due to the variable profile of the resilient damper 106.

The resilient damper 106 shown in the Figures has an "hourglass" profile shape which has rotational symmetry about the longitudinal axis 214, with a reduced-diameter midsection (near D4) to facilitate longitudinal compression as described below. However, any suitable compressible profile shape, including but not limited to a cylinder, accordian- or concertina-fold, spiral (e.g., coil spring) or any other (symmetrical or asymmetrical) profile shape or combination of profile shapes, may be provided by one of ordinary skill in the art for a particular embodiment of the present invention.

Figure 3:
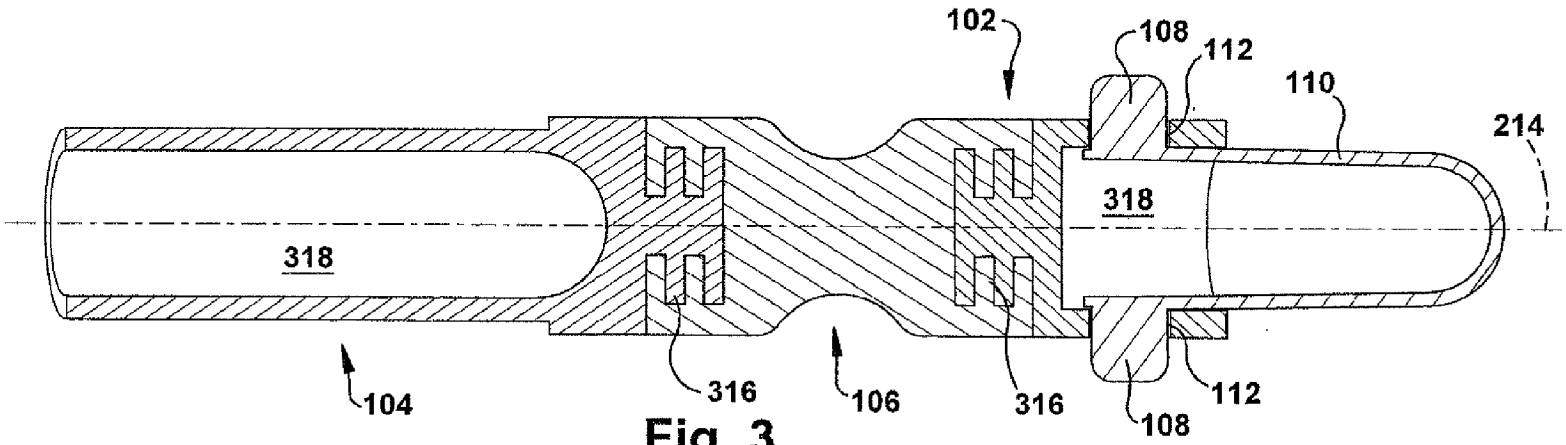
FIG. 3 is a cross-sectional view taken along line 3-3 in FIG. 2.

FIG. 3 is a cross-sectional view of the device 100 taken along line 3-3 of FIG. 2. In FIG. 3, the single-piece construction of the device 100 is shown in detail. The resilient damper 106 and at least a chosen one of the proximal and distal end members 102 and 104 (here, both) can be integrally formed into a unitary whole in the embodiment shown in the Figures. The term "integrally formed" is used herein to indicate a manufacturing process, such as overmolding, in which the so-described structures may be comprised of various pieces at some time(s) during the manufacturing process, but these separate components or subassemblies are assembled into a unitary or monolithic whole, not intended for later disassembly, by the time the production/manufacturing work is complete. Alternatively, "integral formation" need not include separate components at any time but could instead comprise a single structure throughout the manufacturing process. A "unitary whole" is, similarly, an item which is self-contained and complete as a single piece when ready for sale/use and which the user is not expected to assemble or disassemble but simply to handle and use as a one-piece structure.

The term "overmolding" is used herein to indicate any process by which multiple materials and/or multiple moldings of a single material are molded into one unitary whole finished product. Examples of overmolding processes which can be used with the present invention include multi-shot molding, multi-component molding, in-mold assembly, two-shot molding, double-shot molding, multi-inject molding, insert molding, and any other suitable type, or combination of types, of overmolding processes. The device 100 need not necessarily be made via molding, however, and one of ordinary skill in the art will readily be able to produce a device having desirable characteristics for a particular application using any desired production technique(s) and/or material(s).

Optionally, and particularly when the integral formation is accomplished by overmolding, at least a chosen one of the proximal and distal end members 102 and 104 can include a surface area increasing structure, such as the depicted disk trees 316, extending longitudinally into the resilient damper 106 to assist with mutual affixation of the integrally formed components of the device 100. The term "affix" is used herein to indicate a physical attachment between the affixed components which holds them in a static position relative to one another.

As can also be seen in FIG. 3, the proximal and/or distal end members 102 and 104 may be at least partially hollow to provide an endcap bore 318 for weight/cost savings, ease of manufacturing (e.g., reducing cycle time in a molding process), accepting other structures (e.g., the snap buttons 108) therein, or for any other reason.

Figure 4A:
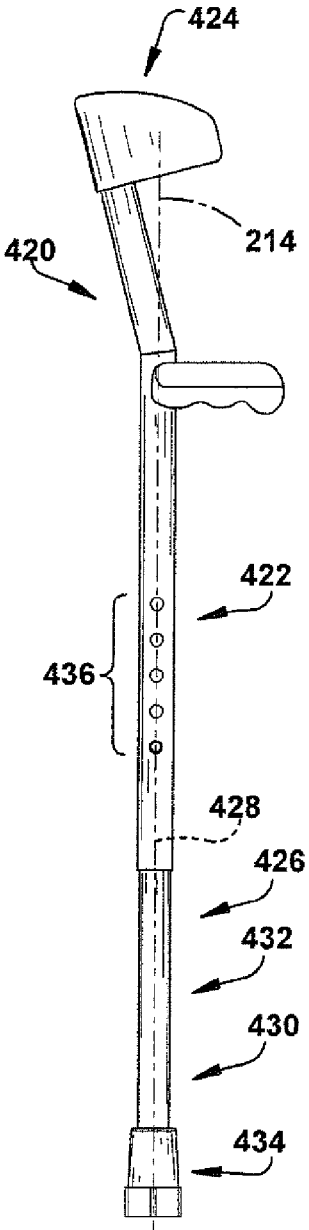
FIGS. 4A-4C depict a sequence of installation of the embodiment of FIG. 1 into an example use environment.
Figure 4B:
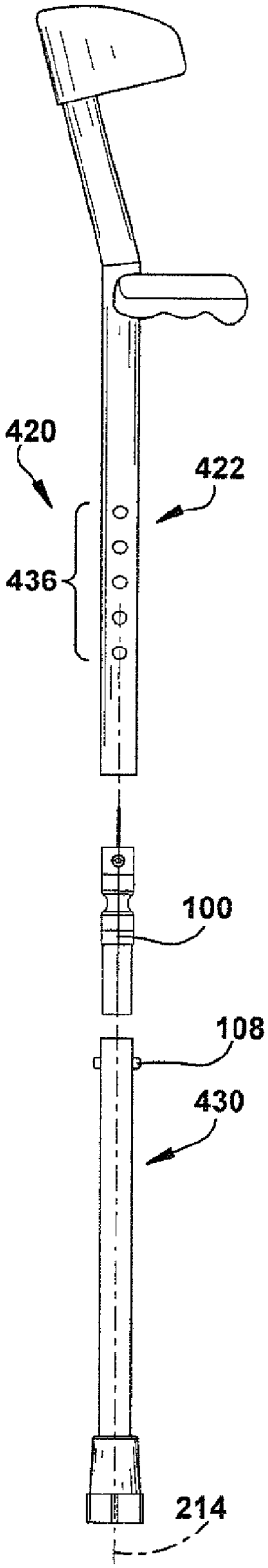
Figure 4C:
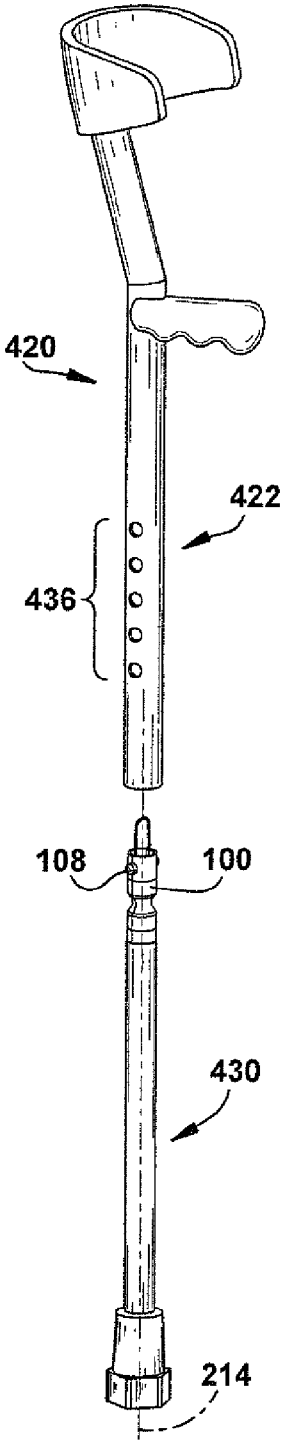

FIGS. 4A-4C depict the assembly of the device 100 into a walking aid 420. Here, the walking aid 420 is depicted as a standard commercially available elbow crutch, but could be any suitable walking aid such as, but not limited to, walking sticks, hiking sticks, elbow crutches, axilla (underarm) crutches, walkers (A.K.A. "Zimmer frames"), rollators, canes, or the like. The device 100 could be provided by a manufacturer with new walking aids 420 (even to the extent of being built-in during manufacture), but could also be sold independently and retrofitted to existing walking aids 420.

The walking aid 420 includes a proximal tube 422 having longitudinally spaced proximal and distal ends 424 and 426. At least the distal end 426 of the proximal tube 422 may have a hollow bore 428. The walking aid 420 also includes a distal tube 430 having longitudinally spaced proximal and distal ends 432 and 434. Here, the distal end 434 of the distal tube 430 includes a crutch tip configured for contact with the ground surface and the proximal end 424 of the proximal tube 422 includes a forearm cuff for engagement with a forearm of the user. It is presumed that, for most use environments of the present invention, the user is in contact with the proximal tube 422 while the distal tube 430 contacts the ground, with the walking aid 420 serving to steady or otherwise assist the user through this chain of contacts.

When a chosen one of the proximal and distal tubes 422 and 430 includes a hollow bore 428, the other one of the proximal and distal tubes may be arranged telescopically with the chosen tube such that the proximal end of the other tube is at least partially located within that hollow bore. For ease of description, it is presumed herein that the proximal tube 422 includes a hollow bore 428 which accepts at least a portion of the proximal end 432 of the distal tube 430.

Additionally, though not shown here, the proximal and/or distal end members 102 and 104, or any other component of the device 100, may include any desired protruding, recessed, or otherwise configured physical features to facilitate usage in the described manner. For example, when at least one of the proximal and distal tubes 422 and 430 includes a bore structure located within a hollow bore 428, the corresponding proximal and/or distal end member 102 and 104 may have a corresponding end member structure for accommodating the bore structure. In such an arrangement, the bore and/or end member structure(s) may optionally be cooperatively used to orient and/or secure the device 100 in the below-described manner.

As another alternative, and particularly when no hollow bore 428 is present (i.e., the proximal and/or distal tubes 422 and 430 are solid bars or rods, without a tube-type lumen), a sleeve (not shown) having a figure 8-shaped cross section may be used to hold the proximal and distal tubes in a relationship allowing for use of the device 100. However, since the vast majority of walking aids 420 are made of telescopically nested aluminum tubes such as those shown in FIGS. 4A-4C, the below description presumes a telescoping relationship between the proximal and distal tubes 422 and 430 (both extending collinearly with the longitudinal axis 214) with snap buttons 108, nib springs, locator pins, spring buttons, splaying mechanisms, or the like provided to adjust a longitudinal dimension of the walking aid 420 for a particular user in a known manner.

More specifically, and as shown in FIGS. 4A-4C, a plurality of longitudinally spaced adjustment holes 436 are provided in the proximal tube 422. At least one snap button 108 is affixed to the distal tube 430. The snap button 108 will usually be spring-loaded such that the user squeezes laterally inward on the snap button to retract it from the adjustment hole 436 at the same time that longitudinal force is used to telescope the distal tube 430 to shorten or lengthen the walking aid 420. The snap button 108 remains in the retracted position against an inner wall of the hollow bore 428 while this telescoping occurs. When the snap button 108 (carried by the distal tube 430) achieves alignment along the longitudinal axis with an adjustment hole 436, the biasing force of the snap button 108 causes the snap button to spring outward and protrude through the wall of the proximal tube 422 through the adjustment hole, thereby preventing further relative longitudinal motion between the proximal and distal tubes.

FIG. 4A depicts a standard commercially available walking aid 420 in the original configuration, with the proximal and distal tubes 422 and 430 in telescopic arrangement. In FIG. 4B, the walking aid 420 has been partially disassembled to separate the proximal and distal tube 422 and 430. The distal end member 104 of the device 100 has been affixed to the proximal end member 432 of the distal tube 430 in any suitable manner, with no relative movement between the distal tube and the distal end member of the device. For example, in the embodiment shown in FIG. 4A-4C, the distal tube 430 has a hollow bore and the distal end member 104 of the device 100 has a variable (stepped) diameter profile, such as that shown in FIG. 1. In this arrangement, the narrower-diameter (e.g., D1) portion of the distal end member 104 of the device 100 is inserted into the hollow bore of the distal tube 430, and the wider-diameter (e.g., D2) "shoulder" of the distal end member of the device prevents the device from sliding all the way into the hollow bore of the distal tube. Optionally, a tight, friction fit between the distal tube 430 and the distal end member 104 of the device 100 provides the affixation, either alone or in combination with another affixation means such as, but not limited to, an adhesive or a mechanical linkage (e.g., a snap button or spring button).

The snap button 108 which was originally provided to the distal tube 430 of the stock/standard walking aid 420 of FIG. 4A is removed from the proximal end 432 member of the distal tube and used instead in conjunction with the device 100, as shown in FIG. 4C, to perform the same locating/securement function for the device as in the stock walking aid. While a new snap button 108 could be provided with the device 100, it is common for walking aid 420 manufacturers to carefully select the snap button 108 for the dimensions and/or weight capacity of a particular walking aid. Accordingly, and particularly in a retrofit situation, reusing a previous snap button 108 still in good condition may provide some performance advantages to some embodiments of a walking aid 420 incorporating the device 100.

Once the device 100 has been affixed to the distal tube 430 as shown in FIG. 4C and the snap button 108 transferred or otherwise provided to the proximal end member 102 of the device, the distal end member 426 of the proximal tube 422 can be moved longitudinally to accept at least a portion of the device (e.g., portions or all of the proximal end member 102 and/or the resilient damper 106) into the hollow bore 428. The snap button 108 is operated as described above to affix the proximal end member 102 of the device 100 within the hollow bore 428 of the proximal tube 422 with no relative movement between the proximal tube and the proximal end member of the device. Optionally, a friction fit may be developed between the proximal end member 102 of the device 100 and the proximal tube 422 to provide the described affixation, either alone or in combination with another affixation means such as, but not limited to, an adhesive or a mechanical linkage (e.g., a snap button or spring button).

Figure 5A:
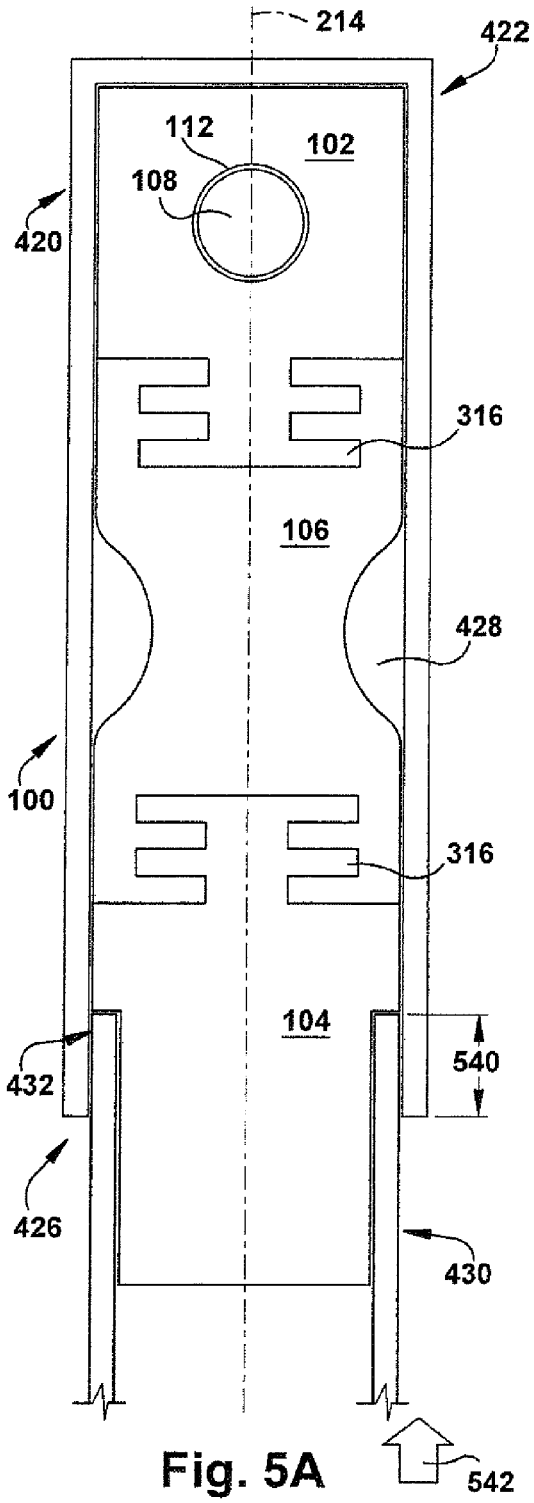
FIGS. 5A-5B schematically depict an example operational sequence of the embodiment of FIG. 1 in the environment of FIGS. 4A-4C.
Figure 5B:
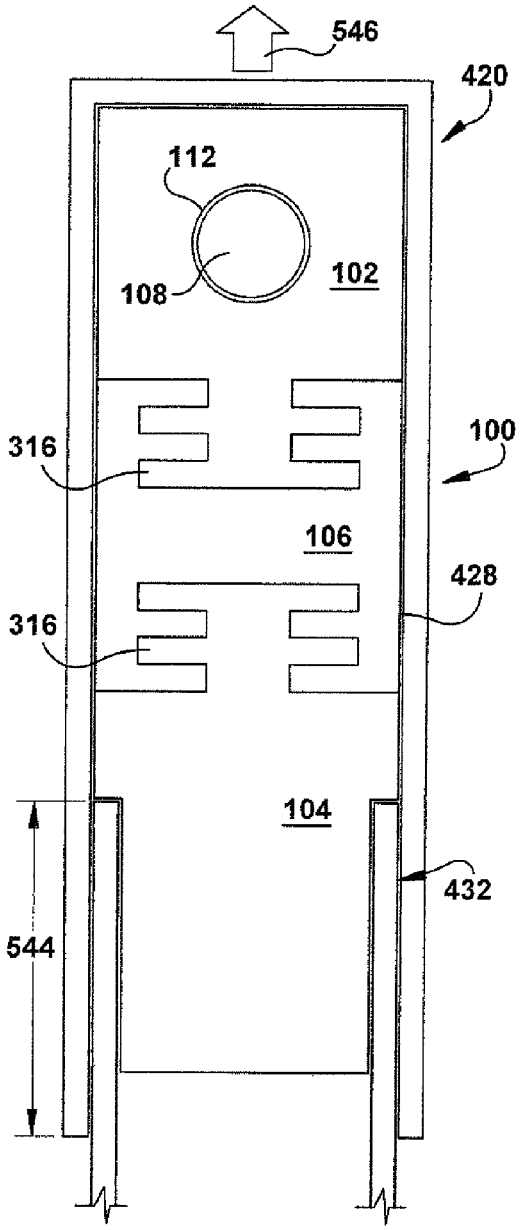

With reference to FIGS. 5A-5B, a partial schematic view of a sequence of operation of the device 100 within the walking aid 420 is shown. While certain structures in these Figures may be friction-fit together or otherwise in contact in the actual device 100 arrangement, space between components is included in these schematic views for clarity.

The proximal end member 102 of the device 100 has been affixed to the proximal tube 422 in FIGS. 5A-5B, such as through action of the snap button 108 which, as shown here, protrudes through the button aperture 112 in the device 100 and through an adjustment hole 436 (not visible in the FIGS.

5A-5B view) of the proximal tube 422. Accordingly, the proximal end member 102 of the device is constrained to move longitudinally with the proximal tube 422.

The distal end member 104 of the device 100 has been affixed to the distal tube 430 in FIGS. 5A-5B, such as through the previously described friction fit. Accordingly, the distal end member 104 of the device is constrained to move longitudinally with the distal tube 430. For the sake of comparison, a first distance 540 can be measured longitudinally between the uppermost (in the orientation of FIGS. 5A-5B) extent of the distal tube 430 and the lowermost extent of the proximal tube 422, which are in a mutually telescoping arrangement.

The resilient damper 106 is located longitudinally between, and affixed to both of, the proximal and distal end members 102 and 104, and is located at least partially within the hollow bore 428 of the proximal tube 422. A longitudinally oriented compressive force—represented schematically at 542 as being oriented toward the proximal direction, and corresponding to the ground reaction force developed during ambulation—having a first force magnitude may be developed during use of the walking aid 420 and exerted upon the distal tube 430. This is shown in FIG. 5A.

Under the compressive force 542, the resilient damper 106 compresses to absorb/dissipate (AKA, "damp") at least a portion of the compressive force while permitting relative longitudinal movement between the proximal and distal tubes 422 and 430, as shown in FIG. 5B. A second distance 544, larger than the first distance 540, shows in FIG. 5B how the distal tube 430 has telescoped up into the hollow bore 428 of the proximal tube 422 under the influence of the compressive force 542. Additionally, FIG. 5B shows how the "hourglass" profile shape has collapsed in a piston-type stroke to permit relative longitudinal movement between the proximal and distal tubes 422 and 430. (The "hourglass" profile shape cutout thus can be seen to avoid laterally outward "squishing" of the material of the resilient damper 106, which could bring that material into potentially deleterious contact with the inner wall of the hollow bore 428.)

The compression of the resilient damper 106 under the compressive force 542 causes the device 100 to absorb and dissipate at least a portion of the compressive force of the first force magnitude, therefore transferring from the resilient damper, through the proximal end member 102 and to the proximal tube 422, a longitudinally oriented compressive force 546 of a second force magnitude, the second force magnitude being lower than the first force magnitude. In this manner, the device 100 acts to cushion the user from at least a portion of the otherwise jarring and harsh shock forces (ground reaction forces) resulting from contact between the walking aid 420 and the ground surface. Upon removal of the compressive force, the resilient damper 106 recovers its shape (i.e., returns to its original compression set under "shape memory") and the device 100 returns to the configuration shown in FIG. 5A, ready for the next "step" or other application of compressive force through the walking aid 420. In some applications of the present invention, the device 100 may be configured so that this "piston stroke", or the difference between first distance 540 and second distance 544, is about five millimeters.

While it is not a primary purpose for many embodiments of the present invention, the device 100 could be designed to at least momentarily store the compressive force absorbed by the resilient damper 106 and later release that compressive force to assist the user with pushing off from the ground in a "pogo" type resilient force arrangement. Particularly when the user is using the walking aid 420 for stability, though, this sort of propulsion might be undesirable as tending to put the user off balance.

It is anticipated that the resilient damper 106 may permanently lose at least some of its elasticity or original "compression set" configuration over time due to age, environmental exposure, work-hardening, or other reasons, and the device 100 could be configured to allow for such deterioration, through designs allowing for altered performance over time, means for alerting the user to the change, and/or any other accommodations.

The proximal and distal end members 102 and 104 may be made in any suitable manner, using any desired material including, but not limited to, nylons, titanium alloys, carbon fibers, aluminum, epoxies, metal alloys, rubber, elastic materials, plastics, elastomers, metals, composite materials, or the like, or any combination thereof. It is anticipated that for most applications of the present invention, the proximal and distal end members 102 and 104 will be relatively rigid compared to the resilient damper 106. The resilient damper 106 may likewise be made in any suitable manner using any desired material including, but not limited to, nylons, titanium alloys, carbon fibers, aluminum, epoxies, metal alloys, rubber, elastic materials, plastics, elastomers, metals, composite materials, shape memory alloys, or the like, or any combination thereof. It is anticipated that for most applications of the present invention, the resilient damper 106 will be relatively flexible compared to the proximal and distal end members 102 and 104. For example, a suitable material for some applications of the resilient damper 106 may be Santoprene™ thermoplastic vulcanizate, available from ExxonMobil Chemical Company of Houston, Tex. It is contemplated that the flexibility, ductility, compressibility, or other physical characteristics of the device 100, such as of the resilient damper 106, could be "tuned" for various users. For example, a resilient damper 106 having a Shore hardness of 35 might be suitable for a child or small adult user, while a resilient damper having a Shore hardness of 55 might be suitable for a large adult user. Optionally, when such "tuned" devices 100 are made available, readily understandable markings or other visual differences (e.g., the color of the resilient damper 106) could be used to help a potential user quickly distinguish among the different configurations.

While aspects of the present invention have been particularly shown and described with reference to the preferred embodiment above, it will be understood by those of ordinary skill in the art that various additional embodiments may be contemplated without departing from the spirit and scope of the present invention. For example, the specific methods described above for using the device 100 are merely illustrative; one of ordinary skill in the art could readily determine any number of tools, sequences of steps, or other means/options for placing the above-described apparatus, or components thereof, into positions substantively similar to those shown and described herein. Any of the described structures and components could be integrally formed as a single unitary/monolithic piece or made up of separate sub-components, with either of these formations involving any suitable stock or bespoke components and/or any suitable material or combinations of materials. The "dashpot" type function of the device 100 can be provided through the described resilient damper, a viscous fluid/hydraulic arrangement, a spring arrangement, any other desired mechanism, or any combination thereof. Though certain components described herein are shown as having specific geometric shapes, all structures of the present invention may have any suitable shapes, sizes, configurations, relative relationships, cross-sectional areas, or any other physical characteristics as desirable for a particular application of the present invention. The device 100 may include a plurality of structures cooperatively forming any components thereof and temporarily or permanently attached together in such a manner as to permit relative motion (e.g., compression, pivoting, sliding, or any other motion) therebetween as desired. Any structures or features described with reference to one embodiment or configuration of the present invention could be provided, singly or in combination with other structures or features, to any other embodiment or configuration, as it would be impractical to describe each of the embodiments and configurations discussed herein as having all of the options discussed with respect to all of the other embodiments and configurations. A device or method incorporating any of these features should be understood to fall under the scope of the present invention as determined based upon the claims below and any equivalents thereof.

Other aspects, objects, and advantages of the present invention can be obtained from a study of the drawings, the disclosure, and the appended claims.

I claim:

1. A force absorbing device for use with a walking aid having proximal and distal tubes arranged in a telescoping configuration for relative movement therebetween along a longitudinal axis, the device comprising:

a proximal end member for affixation within a hollow bore of the proximal tube with no relative movement between the proximal tube and the proximal end member;

a distal end member, longitudinally spaced from the proximal end member, for affixation to a proximal end of the distal tube with no relative movement between the distal tube and the distal end member; and a resilient damper, located longitudinally between, and affixed to both of, the proximal and distal end members, the resilient damper being at least partially located within the hollow bore of the proximal tube, and the resilient damper compressing under a longitudinally oriented compressive force to absorb at least a portion of the longitudinally oriented compressive force while permitting relative longitudinal movement between the proximal and distal tubes;

wherein the resilient damper and both of the proximal and distal end members are integrally formed into a unitary whole through use of an overmolding process.

2. The force absorbing device of claim 1, wherein at least one of the proximal and distal end members is affixed to the corresponding proximal or distal tube via a friction fit therebetween.

3. The force absorbing device of claim 1, wherein at least one of the proximal and distal end members is affixed to the corresponding proximal or distal tube via a mechanical linkage therebetween.

4. The force absorbing device of claim 3, wherein the mechanical linkage includes at least one of a snap button and a spring button.

5. The force absorbing device of claim 1, wherein the chosen one of the proximal and distal end members includes a surface area increasing structure extending longitudinally into the resilient damper to assist with affixation during the overmolding process.

6. The force absorbing device of claim 1, wherein the resilient damper is configured with a variable profile such that a cross-section of the resilient damper taken across a chosen location along the longitudinal axis has a different cross-section footprint than a cross-section of the resilient damper taken across at least one different location along the longitudinal axis.

7. The force absorbing device of claim 1, wherein the proximal end member and the resilient damper are both entirely located within the hollow bore of the proximal tube.

8. A walking aid including a force absorbing device, the walking aid comprising:

a proximal tube having longitudinally spaced proximal and distal ends and defining a longitudinal axis, at least the distal end of the proximal tube having a hollow bore;

a distal tube having longitudinally spaced proximal and distal ends and extending collinearly with the longitudinal axis, the distal tube being arranged telescopically with the proximal tube such that the proximal end of the distal tube is at least partially located within the hollow bore of the proximal tube; and the force absorbing device comprising:

a proximal device end member for affixation within the hollow bore of the proximal tube with no relative movement between the proximal tube and the proximal device end member;

a distal device end member, longitudinally spaced from the proximal end member, for affixation to the proximal end of the distal tube with no relative movement between the distal tube and the distal device end member; and a resilient device damper, located longitudinally between, and affixed to both of, the proximal and distal device end members, the resilient device damper being at least partially located within the hollow bore of the proximal tube, and the resilient device damper compressing under a longitudinally oriented compressive force to absorb at least a portion of the longitudinally oriented compressive force while permitting relative longitudinal movement between the proximal and distal tubes, wherein the resilient device damper and both of the proximal and distal device end members are integrally formed as a unitary whole through use of an overmolding process.

9. The walking aid of claim 8, wherein at least one of the proximal and distal device end members is affixed to the corresponding proximal or distal tube via a friction fit therebetween.

10. The walking aid of claim 8, wherein at least one of the proximal and distal device end members is affixed to the corresponding proximal or distal tube via a mechanical linkage therebetween.

11. The walking aid of claim 10, wherein the mechanical linkage includes at least one of a snap button and a spring button.

12. The walking aid of claim 8, wherein the chosen one of the proximal and distal device end members includes a surface area increasing structure extending longitudinally into the resilient device damper to assist with affixation during the overmolding process.

13. The walking aid of claim 8, wherein the resilient device damper is configured with a variable profile such that a cross-section of the resilient device damper taken across a chosen location along the longitudinal axis has a different cross-sectional footprint than a cross-section of the resilient device damper taken across at least one different location along the longitudinal axis.

14. The walking aid of claim 8, wherein the proximal end member and the resilient damper are both entirely located within the hollow bore of the proximal tube.

15. A method of absorbing compressive force generated in a walking aid, the method comprising the steps of:

providing a proximal tube having longitudinally spaced proximal and distal ends and defining a longitudinal axis, at least the distal end of the proximal tube having a hollow bore;

providing a distal tube having longitudinally spaced proximal and distal ends and extending collinearly with the longitudinal axis;

arranging the distal tube telescopically with the proximal tube such that the proximal end of the distal tube is at least partially located within the hollow bore of the proximal tube;

providing a force absorbing device comprising a proximal device end member, a distal device end member longitudinally spaced from the proximal end member, and a resilient device damper, located longitudinally between, and affixed to both of, the proximal and distal device end members including:

integrally forming the resilient device damper and both of the proximal and distal device end members as a unitary whole; and overmolding the resilient device damper onto both of the proximal and distal device end members;

affixing the proximal device end member within the hollow bore of the proximal tube with no relative movement between the proximal tube and the proximal device end member;

affixing the distal device end member to the proximal end of the distal tube with no relative movement between the distal tube and the distal device end member:

at least partially locating the resilient device damper within the hollow bore of the proximal tube;

exerting upon the distal tube a longitudinally oriented compressive force of a first force magnitude and oriented toward the proximal direction;

compressing the resilient device under the longitudinally oriented compressive force to absorb at least a portion of the longitudinally oriented compressive force of the first force magnitude;

transferring from the resilient device, through the proximal device end member, to the proximal tube, a longitudinally oriented compressive force of a second force magnitude, the second force magnitude being lower than the first force magnitude; and permitting, via compression of the resilient device damper, relative longitudinal movement between the proximal and distal tubes.

16. The method of claim 15, including the step of configuring the resilient device damper with a variable profile such that a cross-section of the resilient device damper taken across a chosen location along the longitudinal axis has a different cross-section footprint than a cross-section of the resilient device damper taken across at least one different location along the longitudinal axis.

17. The method of claim 15, wherein the step of at least partially locating the resilient device damper within the hollow bore of the proximal tube includes the step of entirely locating the proximal end member and the resilient damper within the hollow bore of the proximal tube.

* * * * *